US006905047B2

(12) United States Patent
Kaddatz

(10) Patent No.: US 6,905,047 B2
(45) Date of Patent: Jun. 14, 2005

(54) APPARATUS AND METHOD FOR CHARGING A RIVETING MODULE WITH BREAK-MANDREL BLIND RIVETS OR HOLLOW-CORE RIVETS

(75) Inventor: Uwe Kaddatz, Burgdorf (DE)

(73) Assignee: Avdel Verbindungselemente GmbH (DE)

( * ) Notice: Subject to any disclaimer, the term of this patent is extended or adjusted under 35 U.S.C. 154(b) by 67 days.

(21) Appl. No.: 10/332,517

(22) PCT Filed: Aug. 2, 2001

(86) PCT No.: PCT/DE01/02932

§ 371 (c)(1),
(2), (4) Date: Jan. 9, 2003

(87) PCT Pub. No.: WO02/11921

PCT Pub. Date: Feb. 14, 2002

(65) Prior Publication Data

US 2004/0025314 A1 Feb. 12, 2004

(30) Foreign Application Priority Data

Aug. 3, 2000 (DE) ..... 200 13 365 U

(51) Int. Cl.[7] ..... B65G 59/00
(52) U.S. Cl. ..... 221/278; 227/112
(58) Field of Search ..... 221/278, 290, 221/7, 13, 15, 221, 289; 227/112, 52; 29/809

(56) References Cited

U.S. PATENT DOCUMENTS 5,400,942 A * 3/1995 Gast et al. ..... 227/112

FOREIGN PATENT DOCUMENTS

| | | | |
|---|---|---|---|
| DE | 3825675 | A1 | 2/1990 |
| DE | 9201359 | U1 | 7/1992 |
| DE | 4423165 | C2 | 6/1996 |
| DE | 19842103 | A1 | 3/2000 |

OTHER PUBLICATIONS

International Search Report dated Apr. 6, 2001 and relating to the International Phase of this application. Search Report from the German Patent and Trademark Office dated Apr. 6, 2001 and relating to a corresponding German patent application.

* cited by examiner

*Primary Examiner*—Kenneth Noland
(74) *Attorney, Agent, or Firm*—Trexler, Bushnell, Giangiori, Blackstone & Marr, Ltd.

(57) ABSTRACT

The invention relates to a device and to a method for charging a riveting module (10) that is vertically displaced between a lower placement position and an upper charge position with blind break-mandrel rivets (100) or hollow-core rivets that consist of a shank and a reusable mandrel. Said device comprises a rivet supply (22) and, in addition to the riveting module (10), a funnel (24) that receives the rivet (100) with its mandrel (110) oriented upward and that is displaced laterally between a position below the rivet supply (22) and a position below the riveting module (10) in the charge position.

22 Claims, 13 Drawing Sheets

Figure 1:
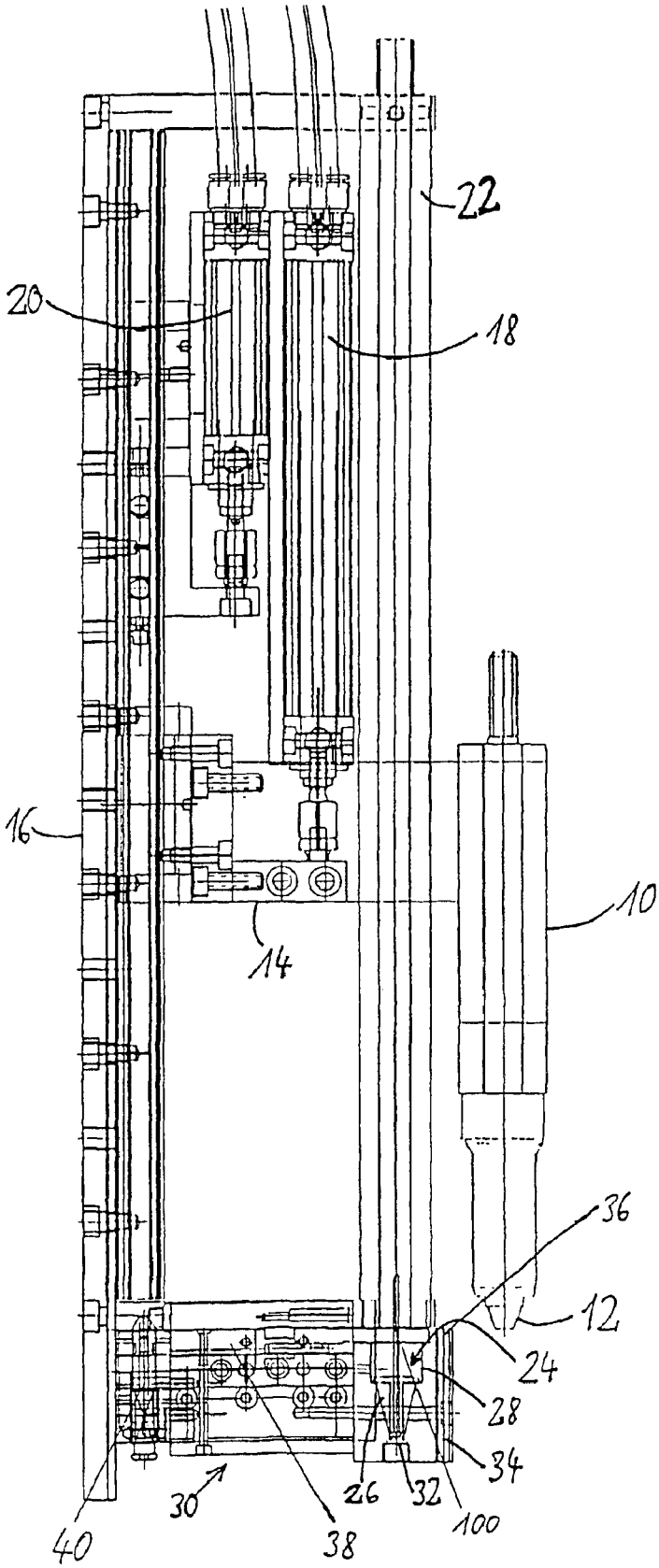

APPARATUS AND METHOD FOR CHARGING A RIVETING MODULE WITH BREAK-MANDREL BLIND RIVETS OR HOLLOW-CORE RIVETS

RELATED/PRIORITY APPLICATIONS

This application claims priority with respect to International Application No. PCT/DE01/02932, filed Aug. 2, 2001, and German Application No. 20013365.9, filed Aug. 3, 2000.

The present invention relates to an apparatus and a method for charging a riveting module with break-mandrel blind rivets or hollow-core rivets consisting of a shell and a reusable mandrel being vertically movable between a lower placing position and an upper charging position.

The feeding of break-mandrel blind rivets or hollow-core rivets and especially the charging of a riveting module with break-mandrel blind rivets or hollow-core rivets always still is problematical. The corresponding devices either are rather complex and, followingly, difficult to maintain and to produce, or are not working sufficiently reliable especially if with the rivets to be placed the mandrel in relation to the shell is bent or is inclined.

It is therefore the task to be solved by the present invention to improve such an apparatus for charging a riveting module with break-mandrel blind rivets or hollow-core rivets in such a way that the construction is drastically simplified and is usable in any deliberate position while simultaneously break-mandrel blind rivets or hollow-core rivets having less than a well centering of the mandrel can be placed without problem as well as to propose a suitable method for charging a riveting module with break-mandrel blind rivets or hollow-core rivets.

According to the invention, the above task in an apparatus for charging a riveting module with break-mandrel blind rivets of the defined species is solved by the features of claims 1, 2 or 3 as well as by the method according to claim 10.

In the meantime, the inventors have found out, too, that the apparatus according to the invention and the method according to the invention excellently are suitable for placing so-called hollow-core rivets. Hollow-core rivets are rivets which in their appearance are similar to break-mandrel blind rivets. Contrary to the break-mandrel blind rivets, the corresponding mandrel is not broken-off with hollow-core rivets but instead is completely withdrawn. Due to this fact, the mandrel can be used again. Hollow-core rivets therefore are consisting of a shell and a re-usable mandrel.

The placing of hollow-core rivets generally is done such that these rivets are fed singularly, the re-usable mandrel is inserted into the shell and the combination of mandrel and shell thereafter is used as a usual break-mandrel blind rivet. Only when placing the only difference is apparent: The mandrel is not broken-off during the placing of the rivet but instead is completely withdrawn from the rivet. He thereafter can be used again.

The invention therefore specifies corresponding apparatuses for charging a riveting module with hollow-core rivets by the technical teaching of claims 13, 14 and 15 as well a corresponding method according to claim 22.

In this connection, it is preferred to provide for a further pressurized air nozzle in the lateral direction of movement of the funnel next to the funnel ending above the funnel. Hereby after the placing of the rivet, the broken-off remainder of the mandrel remaining in the riveting module can be blown out of the riveting module. The apparatus therefore, even working perpendicularly downward, can be operated without a sucking-off of the mandrels. This leads to an enormous saving of air and therefore saving of costs.

In this connection, it is further preferred that the additional pressurized air nozzle is positioned at the side of the funnel which is facing the riveting module. In this way, the operational movements can be optimized further.

According to the invention, it is further especially preferred if the funnel is provided with a section which downwardly is cone-shaped. In this way, for changing to another type of rivet merely the rivet feeding tube has to be exchanged as far as the diameter of the riveting head is not changing. Additionally then the funnel has to be exchanged.

It is further preferred that the funnel above the cone-shaped section is having a slightly broader cylindrical section, wherein the transition between these two sections is formed by an annular horizontal surface the exterior diameter of which is slightly larger than the exterior diameter of the rivet.

Further, it is preferred that the rivet feed is formed as a long straight perpendicular tube. In this way, the feeding of the rivets is further accelerated.

Further, it is especially preferred that all driving means are performed as pneumatic cylinders. In this way, the costs for obtaining the parts and for the operation can be minimized further.

Figure 2:
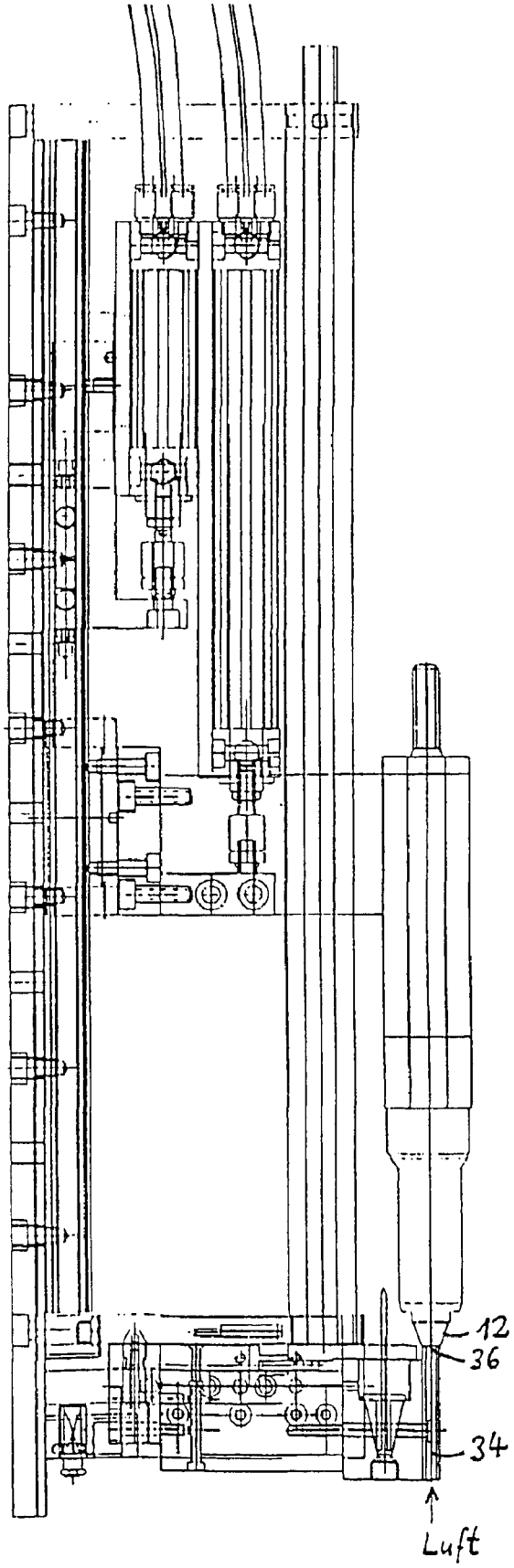
Figure 3:
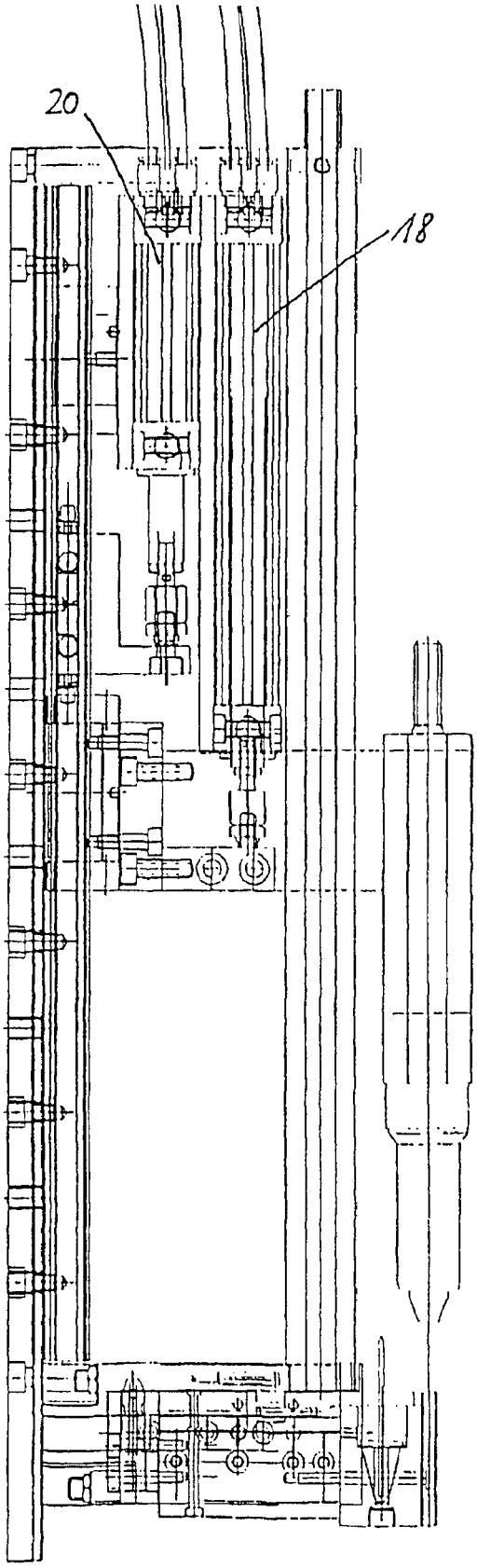
Figure 4:
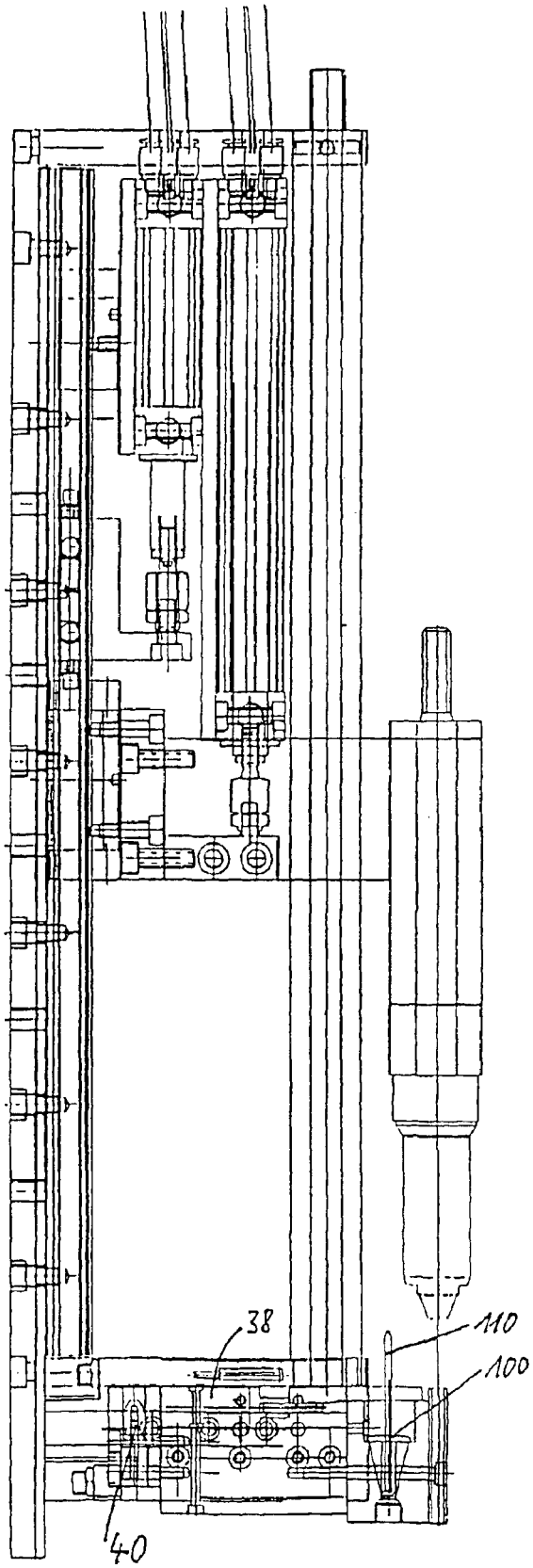
Figure 5:
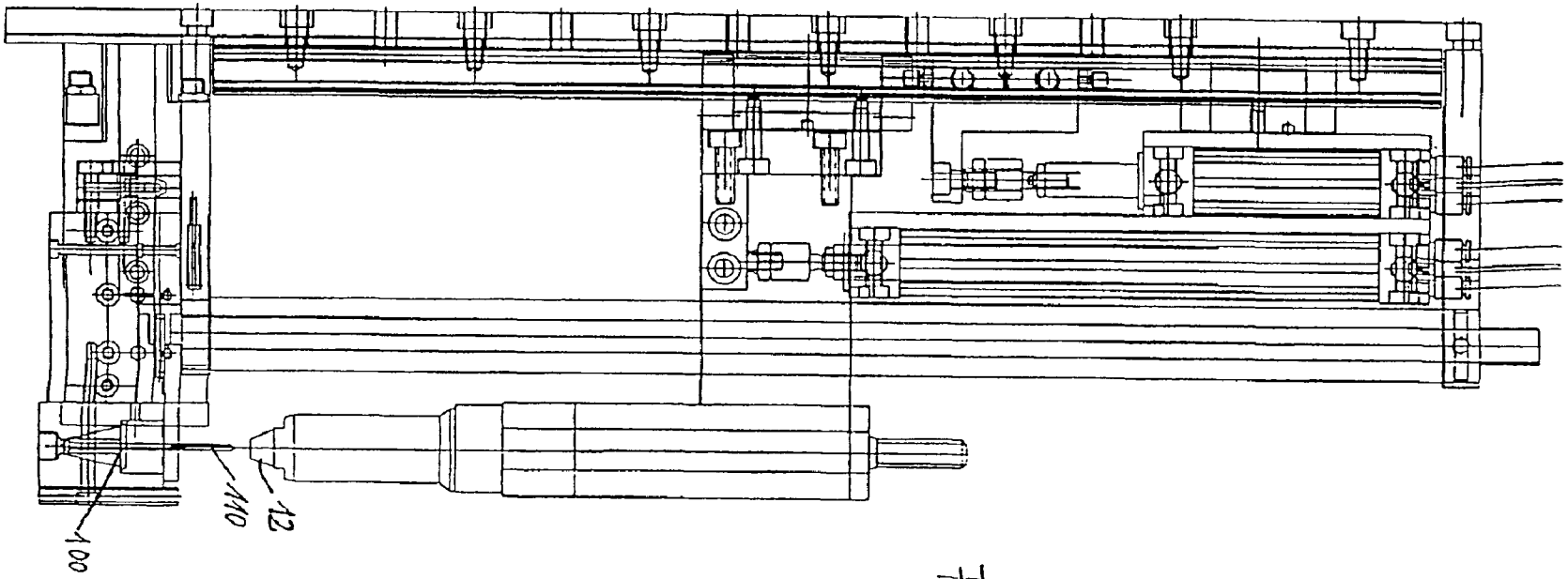
Figure 6:
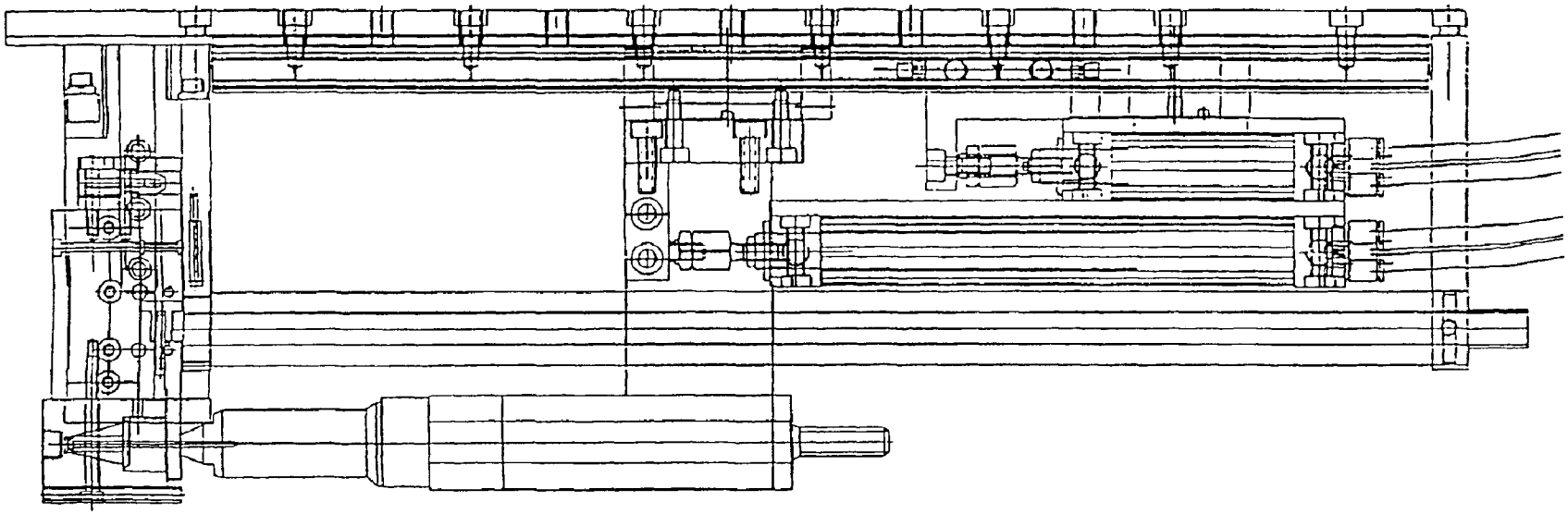
Figure 7:
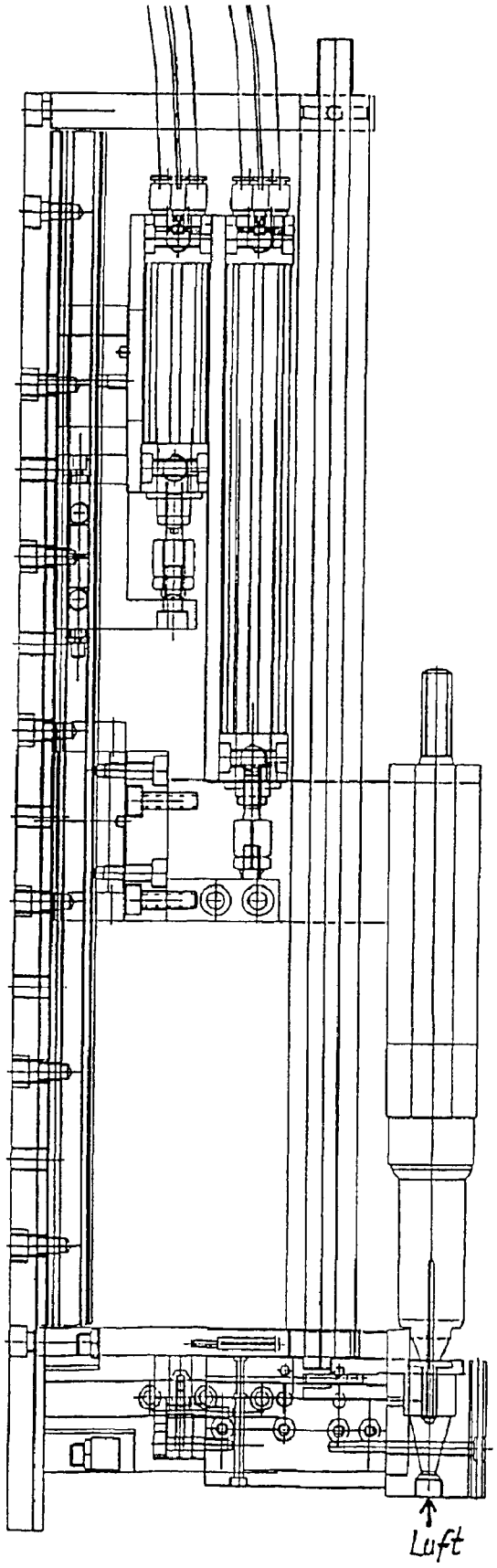
Figure 8:
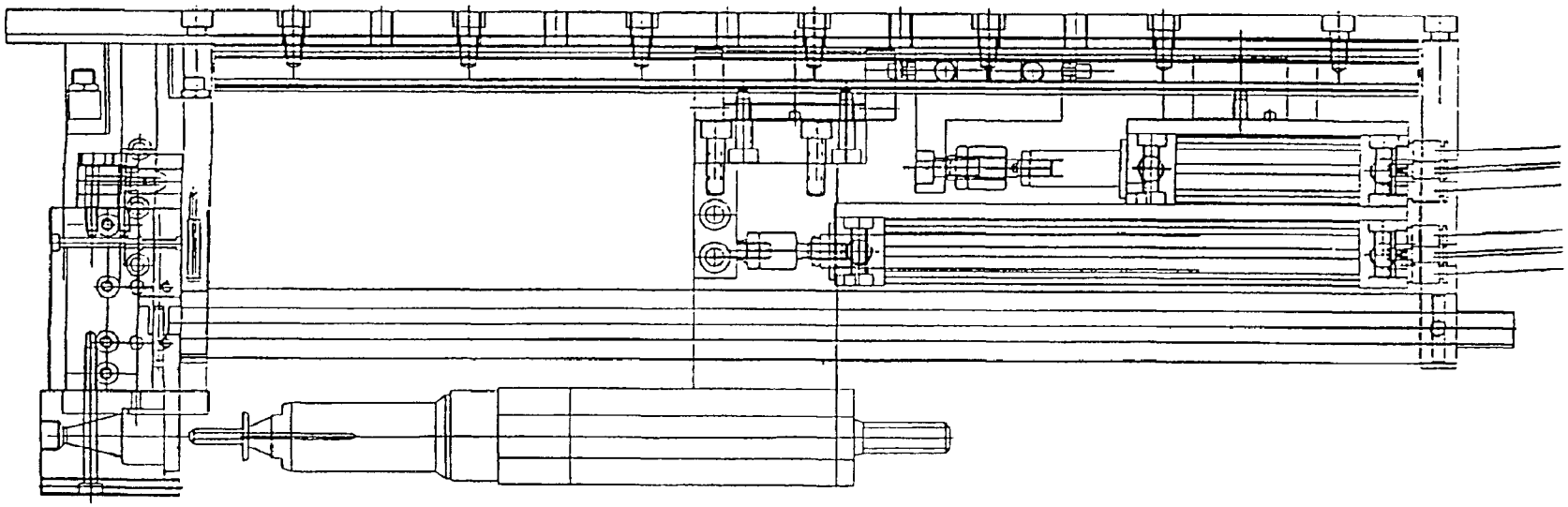
Figure 9:
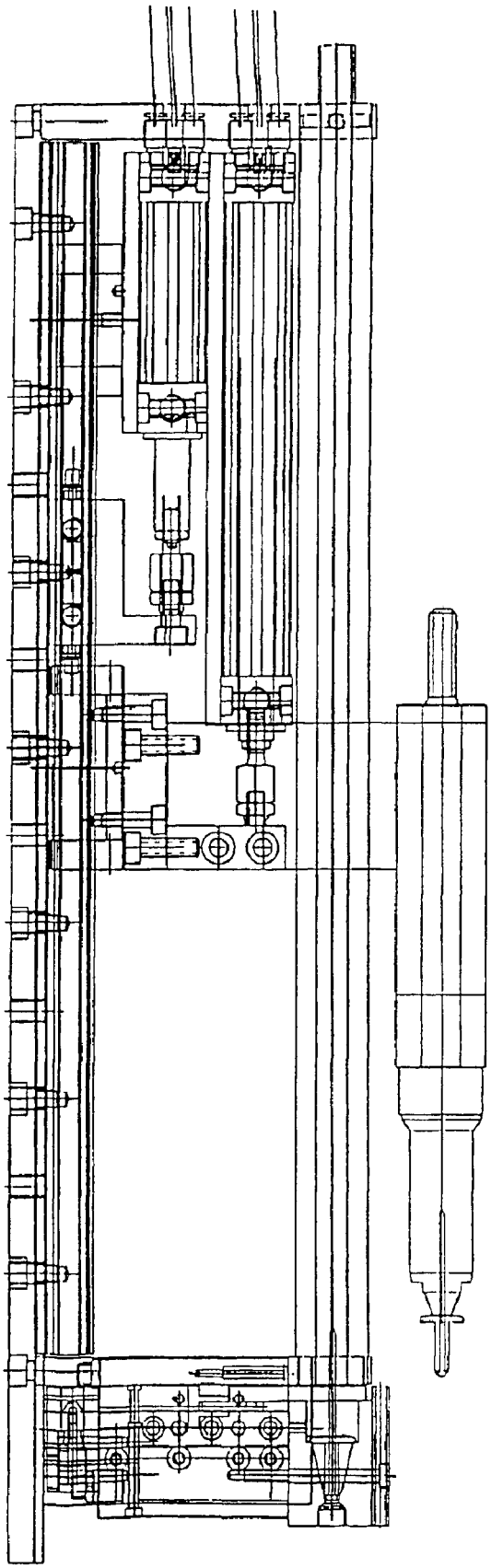
Figure 10:
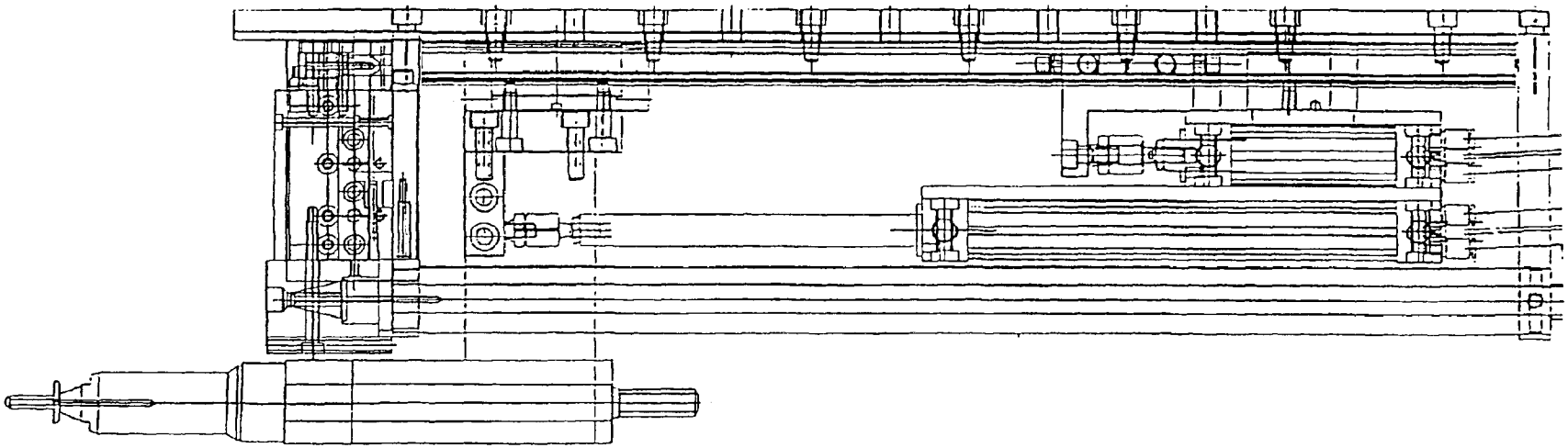
Figure 11:
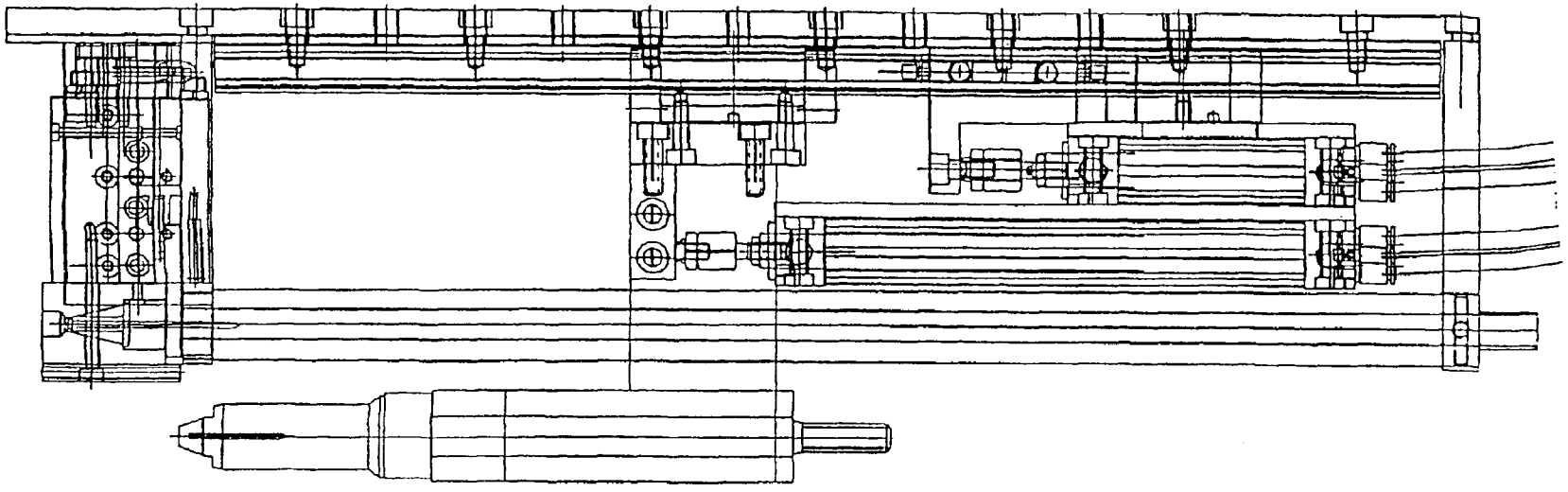
Figure 12:
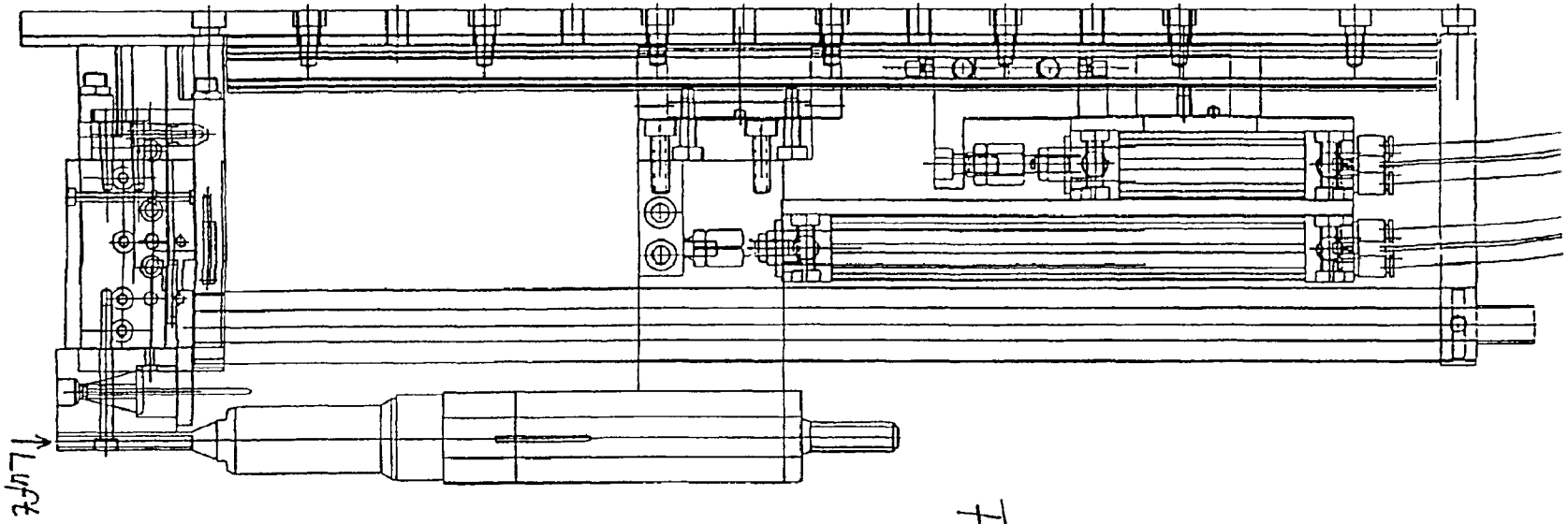
Figure 13:
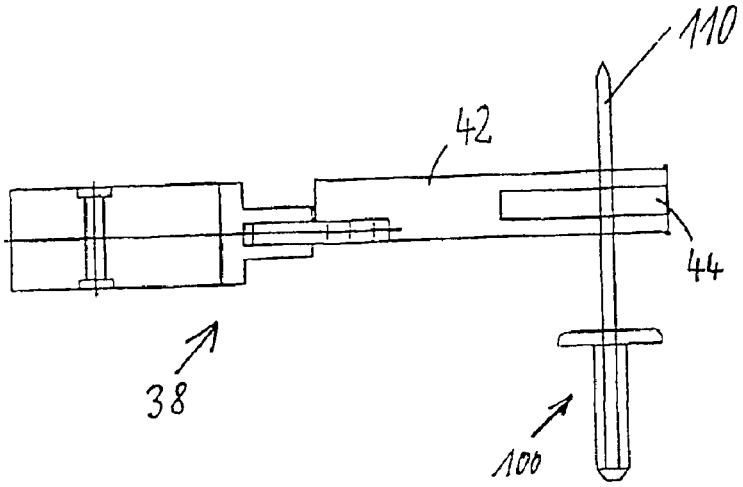
Figure 14:
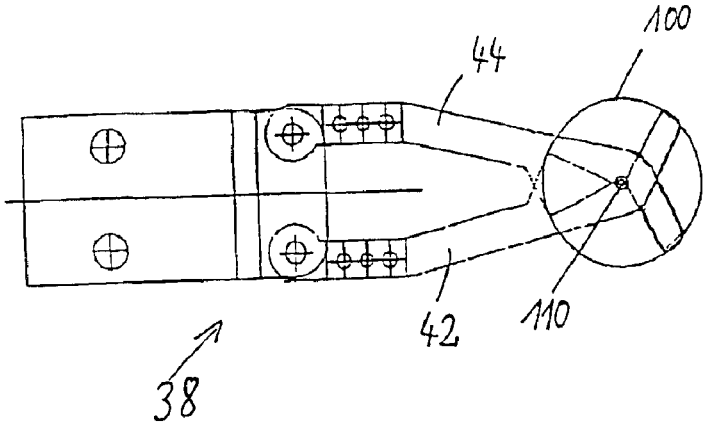
Figure 15:
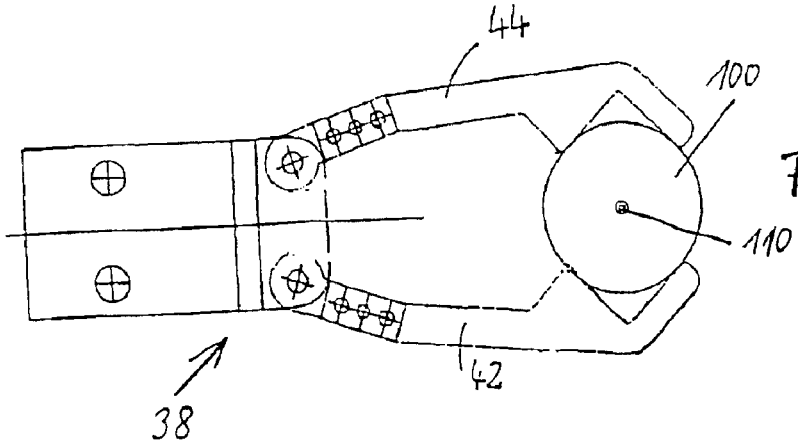

In the following, one exemplary embodiment of the present invention is more detailly described with reference to the enclosed drawings. In the drawings show:

FIG. 1 a cross-sectional view of the apparatus according to the invention in the starting position;

FIG. 2 the apparatus according to FIG. 1 in the blow-off position for blowing out the mandrel;

FIG. 3 the apparatus according to FIG. 1, wherein the riveting module has been moved to the resting position;

FIG. 4 the apparatus according to FIG. 1, wherein the gripping device was closed;

FIG. 5 the preparation for transferring the rivet to the riveting module;

FIG. 6 the riveting module during the centering and receiving of the rivet with the subsequent opening of the gripping device;

FIG. 7 the blowing-in of the rivet into the riveting module with the subsequent generation of a riveting preparatory pressure in the riveting module itself. With this the clamping jaws in the riveting module (not shown) are closed with low hydraulic pressure and are holding the rivet in its position;

FIG. 8 the riveting module charged with the new rivet in the starting position;

FIG. 9 the return of the funnel in its starting position;

FIG. 10 the riveting module in the riveting position;

FIG. 11 the riveting module after placing the rivet;

FIG. 12 the blowing out of the further mandrel from the riveting module;

FIG. 13 a representation of a gripping device according to the invention for the mandrel of the blind rivet with a blind rivet from the side;

FIG. 14 the gripping device according to FIG. 13 from above in the closed state;

FIG. 15 the gripping device of FIG. 13 from above in the opened state.

FIG. 1 is showing an embodiment of an apparatus according to the invention in the starting position in cross-section.

The apparatus according to the invention comprises a riveting module 10, which is equipped with a riveting equipment 12 for placing break-mandrel blind rivets 100. The riveting module 10 by means of a slide 14 is vertically reciprocable upwardly and downwardly on a base support 16. The slide 14 is moved upwardly and downwardly by means of the pneumatic cylinders 18, 20. Between the riveting module 10 and the most outward pneumatic cylinder 18, there is positioned a stiff, straight long tube 22, the interior diameter of which is slightly larger than the exterior diameter of the blind rivets 100. This tube 22 serves as a rivet feed, the break-mandrel blind rivets are blown in by means of pressurized air with their head forward/downward via a usual rivet feed from a usual separating device into the feed tube 22.

In the starting position shown in FIG. 1 exactly below the feed tube 22 there is a funnel 24 consisting of a lower cone-shaped and downwardley tapering section 26 and a slightly broader cylindrical section 28 above said cone-shaped section 26. The transition between these two sections 26, 28 is formed by an annular horizontal surface, the exterior diameter of which is slightly larger than the exterior diameter of the rivet. Correspondingly, the interior diameter of the cylindrical section 28, too, is slightly larger than the exterior diameter of the rivet 100. The funnel 24 is fixed by screws to a horizontally movable slide 30 having an integrated pneumatic cylinder.

On the bottom tip of the cone-shaped section 26 of the funnel 24 there is positioned a pressurized air nozzle 32. Alternatively or additionally in the nosepiece of the riveting module 10, too, there can be provided a suction or vacuum line. At the exterior end, i.e. the end of the slide facing the riveting module 10, there is provided a further pressurized air-line 34 having a further pressurized air nozzle 36 positioned at the height of the upper end of the funnel 24.

Between the feed tube 22 and the funnel 24 additionally there is provided a gripping device 38 mounted on the slide 30, too. Said gripping device is consisting of a pneumatic angle gripper and two special centering gripping arms. The pneumatic stop cylinder 40 provides for an intermediate position of the slide 30. The exact function of the gripping device 38 is more detailly discussed with reference to FIGS. 13 to 15 showing the gripping device 38 in detail. The cylinder 40 is positioned on the slide 30.

In the following, with reference to FIGS. 1 to 12, the working procedure of the apparatus according to the invention shown in FIG. 1 is discussed in detail.

As already stated, FIG. 1 is showing the starting position of the apparatus according to the invention when beginning the work. The first blind rivet 100 already has been deposited by the feed tube 22 and the opened gripping device 38 in the funnel 24 with its head facing forward, wherein the head of the blind rivet either is resting on the annular horizontal surface or in the cone-shaped section of the funnel 24. The gripping device 38 is now closed.

As shown in FIG. 2, the stop cylinder 40 is moved upwardly and thereafter the slide 30 is moved to the exterior such that the further pressurized air nozzle 36 is moved under the nose-opening of the riveting equipment 12. In this position, now pressurized air is blown through the pressurized air-line 34 and the pressurized air nozzle 36 into the riveting equipment to remove remainders of the mandrel of a previously placed rivet possibly still present. In this way, in each operational position, even in the vertically downward operational position shown, an expensive sucking of the mandrel is avoided.

As shown in FIG. 3, now the inner pneumatic cylinder 20 is actuated. Said cylinder thereby is moving himself and the outer pneumatic cylinder 18 connected therewith upwardly. Thereby the slide 14, too, and the riveting module 10 connected therewith is raised.

As shown in FIG. 4, now the stop cylinder 40 is returned.

As shown in FIG. 5, now the slide 30 is moved outwardly until the mandrel 110 of the break-mandrel blind rivet 100 exactly is positioned below the opening of the nosepiece of the riveting equipment 12. The nosepiece of the riveting equipment 12 now is opened.

As shown in FIG. 6, now the pneumatic cylinder 20 is retracted again. Thereby the slide 14 and followingly the riveting module 10 is moved downwardly such that now the mandrel 110 of the break-mandrel blind rivet 100 is exactly centered and received in the nosepiece of the riveting equipment 12. The exact centering of the mandrel 110 with respect to the position of the opening of the nosepiece of the riveting equipment 12 in this connection is occurring by the gripping device 38 which is holding the mandrel 110 in an exactly defined position. Thereafter, however, the centering is ensured by the nosepiece of the riveting equipment 12 and therefore the gripping device 38 can be opened again.

As soon as the gripping device 38 is opened, pressurized air is blown through the pressurized air nozzle 32 into the funnel 24. Thereby the break-mandrel blind rivet 100 is lifted and is completely blown into the rivet placing head 12 as this already is shown in FIG. 7. In this way, it is not necessary anymore to lower the rivet placing head 12 until the rivet 100 is reaching the placing position in the rivet placing head 12. Further, tolerances in positioning can be equalized.

As an alternative to the blowing-in of pressurized air through the pressurized air nozzle 32 in the nosepiece there can be provided a negative pressure or vacuum line which is operated as soon as the gripping device 38 is opened. The break-mandrel blind rivet 100 in this way is sucked into the nosepiece instead, as previously described, being blown-in. In this way, it can be ensured in a better way that the break-mandrel blind rivet is correctly entering the nosepiece. The further procedure again is the same irrespective whether pressurized or suction air is used. Besides that it is possible, too, to combine both methods such that simultaneously pressurized air is blown through the funnel and simultaneously it is sucked-off through the nosepiece.

Now the clamping jaws in the riveting equipment 12 are closing upon the mandrel 110 of the break-mandrel blind rivet 100. The blind rivet 100 now is therefore in a suitable position for placing in the riveting equipment 12.

As shown in FIG. 8, the riveting module 10 now has been raised to enable the slide 30 to return sidewardly and to move the riveting module 10 passing the slide 30 in the placing position. To this end, firstly, as shown in FIG. 8, the inner pneumatic cylinder 20 is again actuated such that the same is lifting the pneumatic cylinder 18 connected therewith and therefore the slide 14 and the riveting module 10 again.

Correspondingly, FIG. 9 is showing the state in which the slide 30 had been returned again, the gripping device 38 still is opened. In this state already the next break-mandrel blind rivet 100 can be fed through the feed tube 22 and can be deposited in the funnel 24.

FIG. 10 then shows the state in which the riveting module is in the placing position. In this state, the pneumatic cylinder 20 has been retracted and the pneumatic cylinder 18 has been fully extended. The slide 14 thereby is completely lowered. The break-mandrel blind rivet 100 now can be placed by the riveting module 10. The gripping device 38 is closed.

After the placing, the riveting module 10 is returned again as this is shown in FIG. 11 by retracting the pneumatic cylinder 18 again. As clearly can be seen from FIG. 11, the broken-off remainder of the mandrel 110 of the break-mandrel blind rivet 100 still is remaining in the riveting equipment 12. As soon as the riveting module 10 therefore is in the position shown in FIG. 11, the slide 30 again can be moved outwardly so far until the nosepiece of the rivet placing head 12 exactly is positioned below the further pressurized air nozzle 36. By means of the pressurized air-line 34 now pressurized air is fed to the pressurized air nozzle 36. Simultaneously the nosepiece of the rivet placing head 12 is opened and by the air stream the rest of the mandrel 110 is blown out upwardly. For example, an exit hose can be connected to the top of the riveting module 10 by the means of which the remainder of the mandrel is guided to a suitable waste container. The state according to FIG. 12 is corresponding to the state of FIG. 2 and therefore the operation procedure cyclically is continued again with FIG. 3.

In the following, the gripping device 38 will be more detailly explained with reference to FIGS. 13 to 15.

FIG. 13 is showing the gripping device 38 from the side while holding the mandrel 110 of a break-mandrel blind rivet 100. The gripping device comprises a split arm 42 into which a further arm 44 is engaging.

As clearly shown in FIGS. 14 and 15, the two arms 42, 44 each are pivotably mounted on a vertical axis. In the closed state, the two arms 42, 44 are interengaging such that the mandrel 110 firmly is gripped. As can be learnt from FIG. 15, the main problem of the construction of the gripping device 38 is residing in the fact that the gripping device 38 is not allowed to become too large in the opened state and that nevertheless the break-mandrel blind rivet 100 can pass between the two arms 42, 44. In the closed state (FIG. 14), the gripping device 38 however has to hold the very thin mandrel 110 firmly.

To solve this problem, the two arms 42, 44 are designed as shown in FIG. 15. They are having an enlarged gripping section in which each a slantly designed recess is provided and closing an right angle and being turned against the direction of the arms 42, 44 by 45°. In this way, both a firm gripping of the mandrel 110 as shown in FIG. 14 can be achieved and an extensive opening, too, such that the entire break-mandrel blind rivet 100 can pass as shown in FIG. 15 without that the device 38 in the opened state is needing unnecessary much room sidewardly.

What is claimed is:

1. Apparatus for charging a riveting module (10) which is movable between a lower placing position and an upper charging position with break-mandrel blind rivets (100) having a rivet feed (22), wherein at the side of the riveting module (10) a funnel (24) for receiving the break-mandrel blind rivet (100) with the mandrel (110) facing upwardly is positioned movably between a position below the rivet feed (22) and a position below the riveting module (10) positioned in the charging position, characterized in that above the funnel (24) a scissor-like acting pincers device (38) is positioned which, in the closed state, is fixing the mandrel (110) of the rivet (100) and which, in the opened state, is letting the rivet (100) pass, the arms of which each are mounted pivotably around a vertical axis.

2. Apparatus for charging a riveting module (10) having a rivet placing head (12) and being movable between a lower placing position and an upper charging position with break-mandrel blind rivets (100) having a rivet feed (22), wherein at the side of the riveting module (10) a funnel (24) for receiving the break-mandrel blind rivets (100) with their mandrel (110) facing upwardly is provided movably between a position below the rivet feed and a position below the riveting module (10) being in its charging position, characterized in that a negative pressure or vacuum line is ending in the rivet placing head (12).

3. Apparatus according to claim 1 or 2, characterized in that in the lateral direction of movement of the funnel (24) at the side of the same a further pressurized air nozzle (36) is provided ending above the funnel (24).

4. Apparatus according to claim 3, characterized in that the further pressurized air nozzle (36) is positioned on the side of the funnel (24) facing the riveting module (10).

5. Apparatus according to claim 1 or 2, characterized in that the funnel (24) is having a cone-shaped section (26) tapering downwardly.

6. Apparatus according to claim 5, characterized in that the funnel (24) above the cone-shaped section (26) is having a slightly broader cylindrical section (28) and that the transition between these two sections (26, 28) is formed by an annular horizontal area, the exterior diameter of which is slightly larger than the exterior diameter of the rivet (100).

7. Apparatus according to claim 1 or 2, characterized in that the rivet feed (22) is performed as a long straight vertically extending tube.

8. Apparatus according to claim 1 or 2, characterized in that all motive means (18, 20) are performed as pneumatic cylinders.

9. A method for loading a riveting module (10) which is movable between a lower placing position and an upper charging position with break-mandrel blind rivets (100) having a rivet feed (22), characterized in that the break-mandrel blind rivets (100) with their head downwardly are deposited in a funnel (24) positioned at the side of the riveting module (10), that the funnel (24) laterally is moved under the retracted riveting module (10), that the riveting module (10) is moved forwardly so far that the mandrel of the break-mandrel blind rivet (100) is projecting into a nosepiece of the riveting module (10), that the break-mandrel blind rivet (100) thereafter by the means of pressurized air from the funnel (24) or by the means of suction air or vacuum from the nosepiece is completely blown into or sucked into the nosepiece, respectively, that the rivet (100) is held by the closing jaws or the vacuum and that the funnel (24) is sidewardly retracted.

10. A method according to claim 9, characterized in that the break-mandrel blind rivet (100) is held on its mandrel (110) and is centered by means of a gripping device preferably in the form of a scissor-like acting pincers device (38) positioned above the funnel (24) as soon as having been dropped in the funnel (24).

11. A method according to claim 9 or 10, characterized in that after finalizing the rivet placing procedure the remaining mandrel (110) of the placed break-mandrel blind rivet is blown out of the riveting module (10) by means of pressurized air from below either from the funnel (24) or from a separate pressurized air-line (34).

12. Apparatus for charging a riveting module (10) being movable between a lower placing position and an upper charging position with hollow core rivets consisting of a shell and a re-usable mandrel having a rivet feed (22), wherein at the side of the riveting module (10) a funnel (24) for receiving the rivets with their mandrel facing upwardly is provided movably between a position below the rivet feed

(22) and a position below the riveting module (10) being in the charging position, characterized in the above the funnel (24) there is provided a scissor-like acting pincers device (38) which, in the closed state, is fixing the mandrel of the rivet and, in the opened state, is letting the rivet pass, the arms of which are pivotably mounted each around a vertically extending axis.

13. Apparatus for charging a riveting module (10) having a rivet placing head (12) and being movable vertically between a lower placing position and an upper charging position with hollow core rivets consisting of shell and re-usable mandrel having a rivet feed (22), wherein at the side of the riveting module (10) a funnel (24) for receiving the rivets with their mandrel facing upwardly is provided movably between a position below the rivet feed (22) and a position below the riveting module (10) in its charging position, characterized in that in the rivet placing head (12) a negative pressure or vacuum line is ending.

14. Apparatus according to claim 12 or 13, characterized in that in the lateral direction of movement of the funnel (24) at the side of the same a further pressurized air nozzle (36) is provided ending above the funnel (24).

15. Apparatus according to claim 14, characterized in that the further pressurized air nozzle (36) is positioned on the side of the funnel (24) facing the riveting module (10).

16. Apparatus according to claim 12 or 13, characterized in that the funnel (24) is having a cone-shaped section (26) tapering downwardly.

17. Apparatus according to claim 16, characterized in that the funnel (24) above the cone-shaped section (26) is having a slightly broader cylindrical section (28) and that the transition between these two sections (26, 28) is formed by an annular horizontal face, the exterior diameter of which is slightly larger than the exterior diameter of the rivet.

18. Apparatus according to claim 12 or 13, characterized in that the rivet feed (22) is performed as a long, straight vertically extending tube.

19. Apparatus according to claim 12 or 13, characterized in that all motive means (18, 20) are performed as pneumatic cylinders.

20. A method for charging a riveting module (10) being movable vertically between a lower placing position and an upper charging position with hollow core rivets consisting of shell and re-usable mandrel, having a rivet feed (22), characterized in that the rivets with their head facing downwardly are deposited in a funnel (24) positioned at the side of the riveting module (10), that the funnel (24) laterally is moved below the retracted riveting module (10), that the riveting module (10) is moved forwardly so far that the mandrel of the rivet is extending into a nosepiece of the riveting module (10) and in that the rivet thereafter by the means of pressurized air from the funnel (24) or by the means of suction air or vacuum from the nosepiece is completely blown into or sucked into, respectively, the nosepiece, whereafter the rivet by the closing clamping jaws or the volume is held and the funnel (24) is retracted laterally.

21. Method according to claim 20, characterized in that the rivet by the means of a gripping device preferably in the form a scissor-like acting pincers device (38) being positioned above the funnel (24) is held at its mandrel and is centered as soon as being dropped into the funnel (24).

22. Method according to claim 20 or 21, characterized in that after finalizing the riveting operation, the remaining mandrel of the rivet placed in the meantime is blown out of the funnel (24) either by pressurized air from below or by a separate pressurized air-line (34).

* * * * *